United States Patent [19]

Persson

[11] Patent Number: 4,771,645

[45] Date of Patent: Sep. 20, 1988

[54] VIBRATING PLATE COMPACTOR

[75] Inventor: Gert Persson, Lyckeby, Sweden

[73] Assignee: Dynapac AB, Solna, Sweden

[21] Appl. No.: 67,612

[22] Filed: Jun. 26, 1987

[30] Foreign Application Priority Data

Jun. 27, 1986 [SE] Sweden ..... 8602882-6

[51] Int. Cl.[4] ..... B06B 1/16; F15B 13/042

[52] U.S. Cl. ..... 74/61; 91/443; 366/128

[58] Field of Search ..... 74/61, 87; 366/116,128; 404/117; 91/443; 209/366.5, 367

[56] References Cited

U.S. PATENT DOCUMENTS

| | | | |
|---|---|---|---|
| 2,868,174 | 1/1959 | Shutt | 91/443 |
| 4,356,736 | 11/1982 | Riedl | 74/61 |
| 4,389,137 | 6/1983 | Riedl | 74/61 X |
| 4,418,609 | 12/1983 | Wickline et al. | 41/443 X |
| 4,481,835 | 11/1984 | Storm | 74/61 |

FOREIGN PATENT DOCUMENTS

| | | |
|---|---|---|
| 3240626 | 5/1984 | Fed. Rep. of Germany . |
| 375845 | 9/1984 | Fed. Rep. of Germany . |
| 443387 | 2/1986 | Sweden . |

*Primary Examiner*—Allan D. Herrmann
*Attorney, Agent, or Firm*—Walter Ottesen

[57] ABSTRACT

A hand-operated forward-reverse vibrating plate compactor which includes a vibrating assembly having two counter-rotating eccentrics. The vibrational force generated by the eccentrics is directional and the forward and reverse motion of the vibrating plate compactor is achieved by changing the phase position of the eccentrics relative to each other. This change in the phase position is accomplished smoothly by means of a hydraulic servo control system which permits a continuously variable adjustment of the speed and intensity of the vibration of the vibrating plate compactor to be made.

2 Claims, 3 Drawing Sheets

VIBRATING PLATE COMPACTOR

FIELD OF THE INVENTION

The invention relates to a hand-operated forward-reverse vibrating plate compactor on which forward and reverse motion is controlled hydraulically by means of a hydraulic servo circuit.

BACKGROUND OF THE INVENTION

A vibrating plate compactor of the type referred to above is disclosed, for example, in German published patent application DE-OS No. 32 40 626. In this vibrating plate compactor, the eccentric element comprises two counter-rotating eccentrically loaded shafts, the phase position of which relative to each other is changed by means of a hydraulic system. On changing the phase position, the direction of the vibration force is also changed and with it the direction of translational motion of the vibrating plate compactor. The eccentrically loaded shafts are rotatably joined by means of gears so that when in rotation, the shafts-always tend to assume a definite phase position relative to each other. In this position, a centrifugal force is generated in a definite direction and as a rule the system for controlling the eccentric shafts is so arranged that a forward motion is imparted to the plate compactor at one of the end positions of the system.

Resetting the eccentrics to a position different to the one they tend to assume requires a comparatively powerful adjusting force, especially in the case of large eccentric elements. In the known configuration, this is accomplished by means of a hydraulic servo system so that the operating force applied to the forward-reverse control can be disregarded.

The phase position of the eccentrically loaded shafts relative to each other is controlled by means of a hydraulic piston which is arranged to move axially inside one of the tubular eccentrically loaded shafts and which, by means of a pin fastened to it and running in a spiral groove, causes the tubular eccentrically loaded shaft to rotate when the piston is moved in an axial direction. In the known configuration, the spiral groove is so arranged that the piston can be moved to two end positions where the vibrational force generated by the eccentrics imparts to the vibrating plate compactor a maximal forward and reverse motion, respectively. Even though the servo circuit reduces the force required for adjustment at the control lever, the lever must be held in the position corresponding to reverse motion since the moment of force from the rotating eccentrics would otherwise force them to assume a position corresponding to forward motion of the vibrating plate compactor.

SUMMARY OF THE INVENTION

It is an object of the invention to provide a vibrating plate compactor with a stepless adjustment of the position of the eccentrics relative to each other thereby making it possible to vary the speed of the plate compactor when in forward or reverse motion and to maintain this speed without requiring the control lever to be held in the appropriate position by the operator. In addition, adjustment of the position of the eccentrics to produce a vertically directed vibrational force is made possible, which is advantageous if it is desired to increase the depth of compaction in any area, such as close beside a wall.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
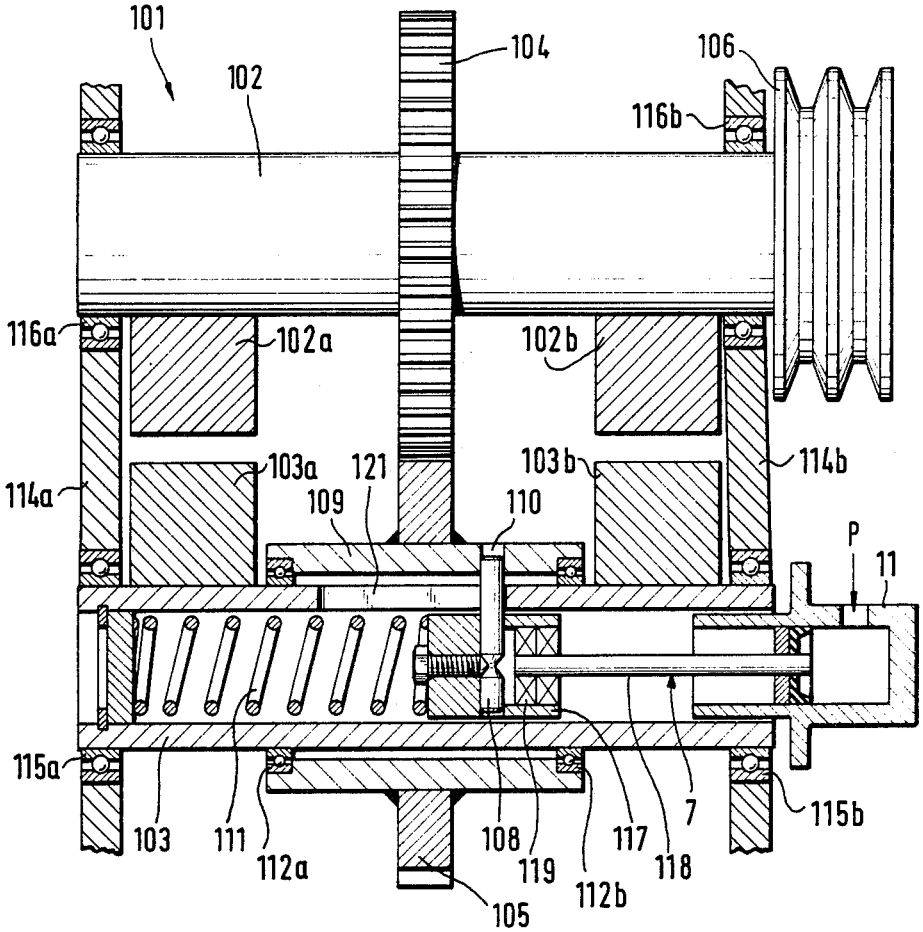
FIG. 1 is a plan view, partially in section, of the vibratory device according to the invention and includes an arrangement for the stepless adjustment of the relative positions of eccentrically loaded shafts.

An eccentric element 101 for generating directional vibration is shown in FIG. 1. Eccentrically loaded shafts 102 and 103 are rotatably connected to each other by gears 104 and 105. The shaft 102 is provided with eccentric weights (102*a*, 102*b*) and shaft 103 is provided with eccentric weights (103*a*, 103*b*). This arrangement causes the eccentrically loaded shafts to rotate in opposite directions. The rotational motion of shaft 102 and with it shaft 103 is provided by V-belt pulley 106 which is driven from the engine of the vibrating plate compactor.

Eccentrically loaded shaft 103 is tubular and capable of rotating relative to shaft 102, thereby permitting the phase positions of the eccentrically loaded shafts relative to each other to be changed and with it the direction of the vibrational force. The shaft 103 is rotated hydraulically by means of a hydraulic piston 7 in which a pin 108 is rigidly mounted at right angles thereto and arranged to slide in a spiral groove 110 cut in sleeve 109. The pin 108 is guided in slot 121 of shaft 103. The slot 121 has a length correspoding approximately to the length of the stroke of piston 7. A spring 111 is mounted inside shaft 103 at the rear of piston 7. The spring 111 presses against the cup-shaped member 117 mounted on the left-hand of the piston rod 118 to resiliently bias piston 7 to one of its end positions when it is not actuated by oil pressure; that is, the spring 111 presses the piston to one of its end positions when pin 108 comes into contact with one of the end positions of spiral slot 110.

Figure 3:
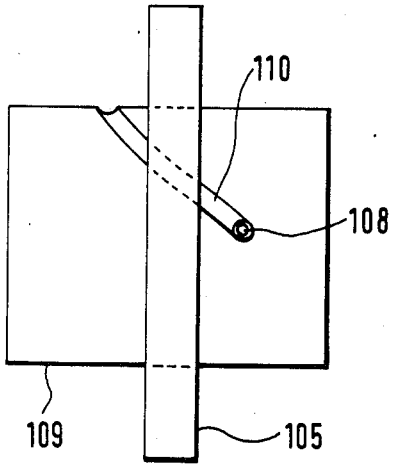

The spiral slot 110 is shown in top view in FIG. 3. By adjusting the displacement of piston 7, the position of the pin 108 is moved in the spiral slot thereby angularly displacing shaft 103 relative to sleeve 109 and therefore relative to shaft 102 thereby adjusting the vibratory forces imparted by the counter-rotating shafts to the vibrating plate compactor.

Sleeve 109 is rigidly secured to gear 105, which together with sleeve 109 is mounted so as to be capable of rotating on shaft 103 by means of bearings (112*a*, 112*b*). The rotating motion is transmitted from shaft 102 to 103 by pin 108.

The shaft 103 is rotatably journalled in the walls (114*a*, 114*b*) of the chassis frame of the vibrating plate compactor via bearings (115*a*, 115*b*) and the vibratory motion of shaft 103 is imparted to the compactor chassis frame via these bearings. Similarly, eccentrically loaded shaft 102 is rotatably journalled in the walls (114*a*, 114*b*) via bearings (116*a*, 116*b*), respectively, which also transmit the vibratory movement of the shaft 102 to these walls.

The hydraulic cylinder 11 is stationary and piston 7 moves in the direction of piston rod 118; however, shaft 103 rotates and bearings 119 are provided in the cup-shaped member 117 to permit the latter and the shaft 103 as well as the pin 108 to rotate relative to the piston 7.

Figure 2:
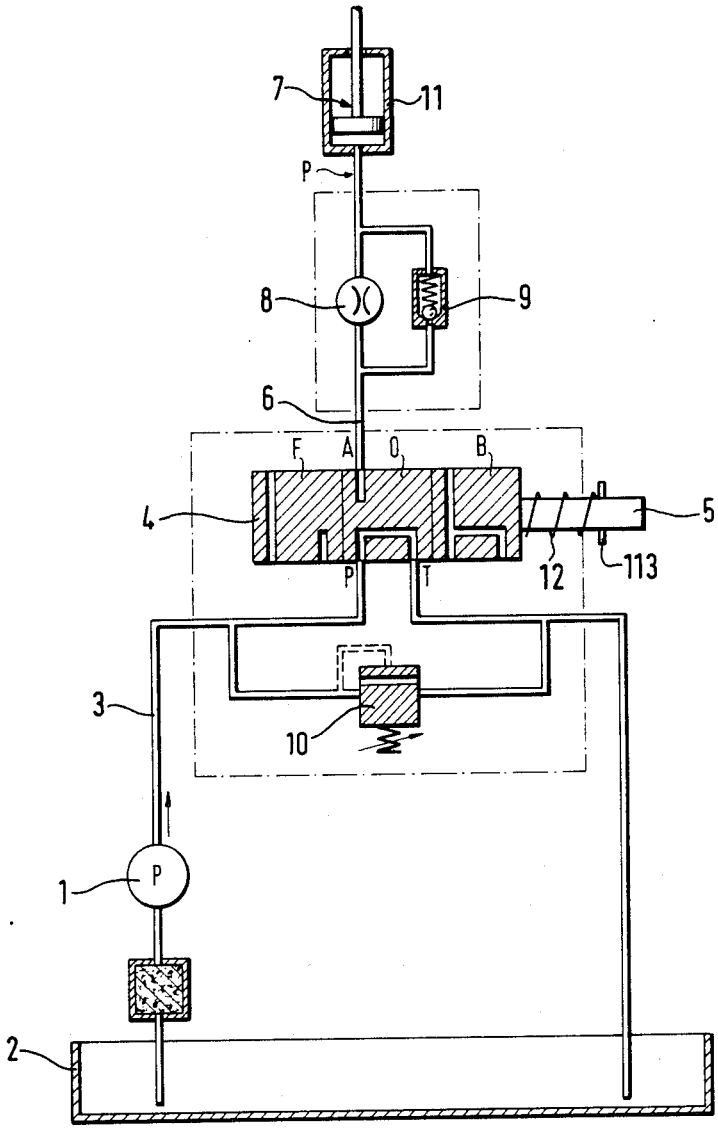
FIG. 2 is a schematic of the hydraulic adjusting system according to a preferred embodiment of the invention; and, FIG. 3 is a schematic top view of a sleeve arranged concentrically with respect to one of the two eccentrically loaded shafts shown in FIG. 1.

The hydraulic schematic shown in FIG. 2 includes a pump 1 which is driven directly by the eccentric shafts of the eccentric element. The pump communicates with an oil tank 2 and pumps oil via line 3 to three-way valve 4 having positions F, O and B. By means of control lever 5, line 3 can be connected to an outgoing line 6 which, via the connection P (see FIGS. 1 and 2), connects three-way valve 4 with the hydraulic piston 7 (this piston is also designated by 7 in FIG. 1) used for setting the position of the eccentrics. The hydraulic piston 7 is mounted for movement within hydraulic cylinder 11 which is also identified in FIG. 1 by reference numeral 11.

By setting control lever 5 to position F, piston 7 is connected to pump 1 and the piston is moved in an axial direction, with adjustment of the eccentrics as a result, to a setting that corresponds to full speed in a forward direction. A throttle valve 8 is connected in the line between piston 7 and three-way valve 4. A check valve 9 is connected in parallel with the throttle valve 8. In position F, a connection between pump and piston is made via check valve 9.

Control lever 5 is spring-loaded and as soon as it is released, the lever 5 returns automatically to a neutral position O in which position oil is pumped to the tank and the return line from piston 7 is blocked.

When piston 7 is connected to pump 1, the piston is moved comparatively slowly to its end position due to the counterforce exerted on piston 7 by spring 111 (see FIG. 1). The duration of this movement is determined by the size of pump 1, the preset pump pressure and the size of spring 111.

By actuating lever 5 briefly by means of a short, sharp blow and then releasing it so that it returns to the neutral position, piston 7 is caused to move only a short distance, resulting in forward motion of the plate compactor at reduced speed.

If piston 7 is in the position for forward motion and lever 5 is set to position B for reverse motion, piston 7 will be connected to tank 2. The force exerted by spring 111 (FIG. 1) moves the piston in a downward direction viewed on the drawing (FIG. 2) and oil is pressed from piston to tank. However, check valve 9 does not allow any oil to pass in this direction but forces the oil to pass through throttle valve 8, with the result that the return movement of the piston takes place at reduced speed. The throttle valve is in this context of such dimensions that the speed of piston 7 is the same in both directions of movement.

Control lever 5 returns to neutral position O from position F and position B alike. Accordingly, if it is desired to reverse the plate compactor at reduced speed, it is only necessary to actuate lever 5 briefly by means of a short sharp movement whereafter it will return to the neutral position.

The three-way valve 4 coacts with a spring 12 shown in FIG. 2. The spring 12 is secured to rigid wall 13. Accordingly, when the operator pulls on actuator 5 to bring the valve 4 into position F, the spring 12 becomes compressed so that when the operator releases the actuator 5, the valve 4 returns to its neutral zero position shown in FIG. 2. On the other hand, if the operator presses against the actuator 5 to being valve 4 into position B, then the spring 12 is stretched and placed in tension so that upon releasing the actuator 5, the valve 4 returns to position O under the force of the spring 12.

In the position O, the three-way valve 4 completely interrupts the connection between the outgoing line 6 and the pump 2 as well as between the line 6 and the tank 2 thereby maintaining the hydraulic condition achieved in the hydraulic cylinder 11 as a consequence of the previous switching position B or F.

The hydraulic adjusting system of the vibrating plate compactor according to the invention presupposes a continuously variable eccentric element. This allows the vibrating plate compactor to be given a continuously variable translatory motion from zero to maximum speed both forward and in reverse as well as a stationary vibratory motion in which case the direction of the vibrational force is vertical.

Theoretically it is possible with the known embodiment of an eccentric adjusting device to hold the control lever in a position between the two end positions of the spiral groove. In practice, however, this is impossible because of vibration in the lever, at least if it is desired to keep the lever in the same position the entire time.

It is understood that the foregoing description is that of the preferred embodiments of the invention and that various changes and modifications may be made thereto without departing from the spirit and scope of the invention as defined in the appended claims.

What is claimed is:

1. A hand-operated vibratory device comprising:

a vibrating assembly including two interconnected counter-rotating eccentric shafts for generating vibratory movement; and, a hydraulic servo circuit arrangement for changing the phase position of said eccentric shafts with respect to each other, the circuit arrangement including:

a hydraulic fluid tank;

a hydraulic fluid pump connected to said tank;

a hydraulic cylinder;

a piston movably mounted in said cylinder and coupled to one of said eccentric shafts for rotationally shifting said one eccentric shaft so as to change its phase position relative to the other one of said eccentric shafts;

a multi-position valve interconnecting said pump and said hydraulic cylinder for causing said device to move in a forward or reverse direction as desired, said multi-position valve being switchable between: a forward position wherein said piston is movable to a first location so as to change said phase position to cause said device to move in the forward direction; a rearward position wherein said piston is movable to a second location so as to again change said phase position to cause said device to move in a rearward direction; and, a neutral position wherein said piston is bypassed and the fluid moved by said pump is returned to said tank;

an actuator for acting on said valve for switching the same between said positions;

resilient biasing means for resiliently biasing said actuator to return said valve to said neutral position when not actuated; and, means for holding said piston in its preset location when said resilient biasing means returns said valve to said neutral position.

2. The vibratory device of claim 1, comprising a throttle valve connected into said hydraulic circuit between said piston and said valve.

* * * * *

UNITED STATES PATENT AND TRADEMARK OFFICE

CERTIFICATE OF CORRECTION

PATENT NO. : 4,771,645

DATED : September 20, 1988

INVENTOR(S) : Gert Persson

It is certified that error appears in the above-identified patent and that said Letters Patent is hereby corrected as shown below:

In column 2, line 40: delete "correspoding" and substitute -- corresponding -- therefor.

In column 2, line 44: after "left-hand", insert -- end --.

In column 3, line 68: delete "being" and substitute -- bring -- therefor.

Signed and Sealed this

Thirteenth Day of June, 1989

*Attest:*

DONALD J. QUIGG

*Attesting Officer*

*Commissioner of Patents and Trademarks*